US005174569A

United States Patent [19]

Ngai

[11] Patent Number: 5,174,569

[45] Date of Patent: Dec. 29, 1992

[54] ROUTE DIVERTER FOR A SLOT RACING TRACK

[75] Inventor: Kam-Fai Ngai, Sanpokong, Hong Kong

[73] Assignee: Artin Industrial Company Limited, Hong Kong

[21] Appl. No.: 635,736

[22] Filed: Dec. 28, 1990

[51] Int. Cl.[5] ..... A63F 9/14

[52] U.S. Cl. ..... 273/86 R; 273/86 B; 104/60; 104/79; 104/67

[58] Field of Search ..... 273/86 R, 86 B, 86 C, 273/86 D; 446/444, 445, 446, 447; 104/53, 54, 55, 60, 63, 64, 67, 79, 80

[56] References Cited

U.S. PATENT DOCUMENTS

| | | | |
|---|---|---|---|
| 1,715,891 | 6/1929 | Beck | 104/79 |
| 3,209,491 | 10/1965 | Roeper | 446/444 X |
| 3,316,401 | 4/1967 | Cramer | 104/60 X |
| 3,858,878 | 1/1975 | Nemeth et al. | 104/54 X |
| 3,970,309 | 7/1976 | Sato | 273/86 B |
| 4,185,409 | 1/1980 | Cheng | 104/79 X |
| 4,355,807 | 10/1982 | Prehodka | 273/86 R |
| 4,513,966 | 4/1985 | Mucaro et al. | 273/86 B |
| 4,919,052 | 4/1990 | Yoneda et al. | 104/54 |

FOREIGN PATENT DOCUMENTS

| | | |
|---|---|---|
| 2043469 | 10/1980 | United Kingdom . |
| 2114903 | 9/1983 | United Kingdom . |

*Primary Examiner*—George J. Marlo
*Assistant Examiner*—William M. Pierce
*Attorney, Agent, or Firm*—Andrus, Sceales, Starke & Sawall

[57] ABSTRACT

A route diverter for selecting a first or a second track route for a slot track vehicle to follow is disclosed. The diverter is engageable with track portions of the first and second routes and comprises a platform and means for supporting the platform for see-saw movement between first and second positions in which the first and second routes are respectively selected, the platform being movable in response to movement of a slot track vehicle past the diverter to change the route selected.

4 Claims, 6 Drawing Sheets

ROUTE DIVERTER FOR A SLOT RACING TRACK

BACKGROUND AND FIELD OF THE INVENTION

This invention relates to improvements in slot racing car games.

Slot car racing games, in which a track having lanes upon which model cars race are known. In such games, a racing circuit comprising a plurality of track segments connected together is provided. Each segment has two or more slots, each slot being engageable by a model car and defining a lane. Electrical pick up connections in the form of metallic rails are provided on each side of the slot to engage corresponding electrical pick ups in the car and thus Provide power to the car. Each lane is provided with an electrical hand controller for use by a player so that the player may control his car.

It is an object of the invention to provide apparatus which will enhance the excitement of such a slot car racing game.

SUMMARY OF THE INVENTION

According to the invention, there is provided a route diverter for selecting a first or a second track route for a slot track vehicle to follow, the diverter being engageable with track portions of the first and second routes and comprising a platform and means for supporting the platform for movement between first and second positions in which the first and second routes are respectively selected, the platform being movable in response to presence of a slot track vehicle to change the route selected.

The route diverter of the invention provides an obstacle for a slot racing track in which a passing slot racing vehicle causes the diverter to switch to an alternative route for a subsequent vehicle to follow which route may, for example, be of a more tortuous path. Thus, the route diverter causes the cars to interact with one another (one changing the route for the other), thus adding to the interest and excitement of the game.

In a preferred form, the first and second routes are disposed at different heights and the platform provides a section of track forming part of the first, upper route. The Platform lies in the path of an oncoming vehicle which is propelled by its own motion onto the platform. Movement of the vehicle across the surface of the platform causes this to pivot in a see-saw manner and expose the second lower route, which a subsequent vehicle is constrained to follow.

BRIEF DESCRIPTION OF THE DRAWINGS

An embodiment of the invention will now be described by way of example with reference to the accompanying drawings in which.

DETAILED DESCRIPTION OF THE PREFERRED EMBODIMENT

Figure 1:
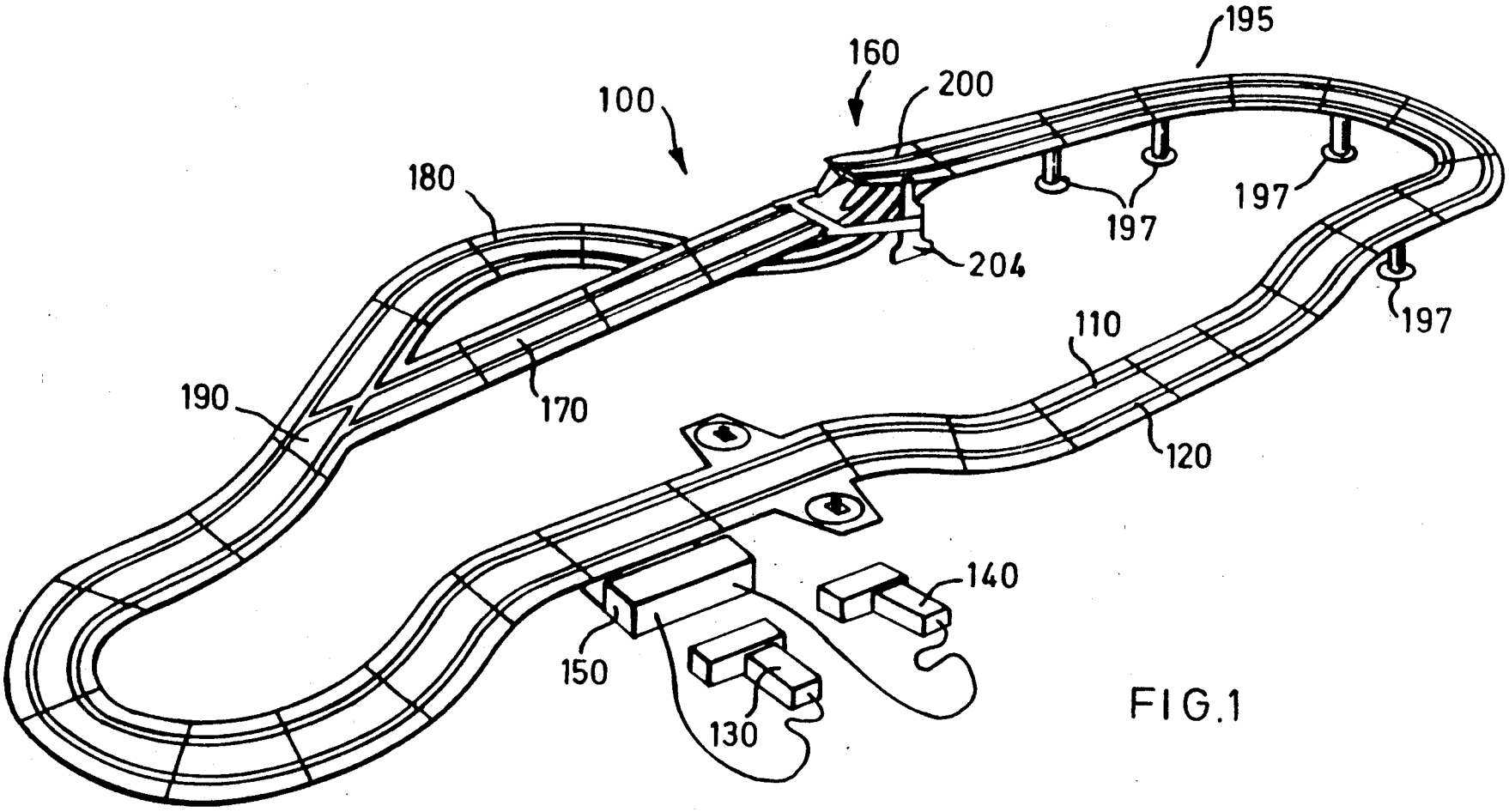
FIG. 1 is a perspective view of a slot car racing track including an embodiment of the invention.
Figure 4:
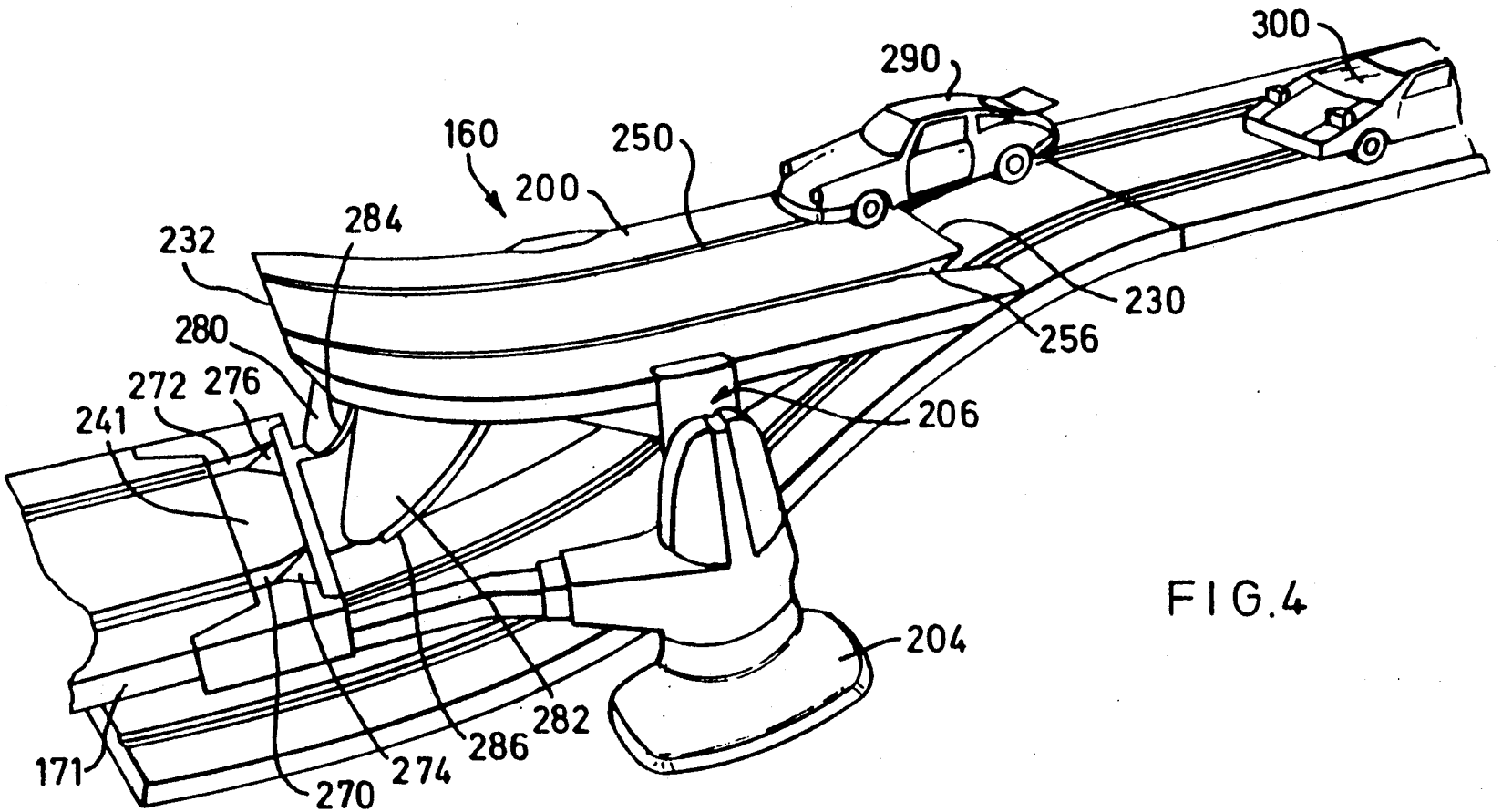
FIGS. 4, 6 and 6 are perspective views showing operation of the embodiment shown in FIGS. 2 and 3.
Figure 5:
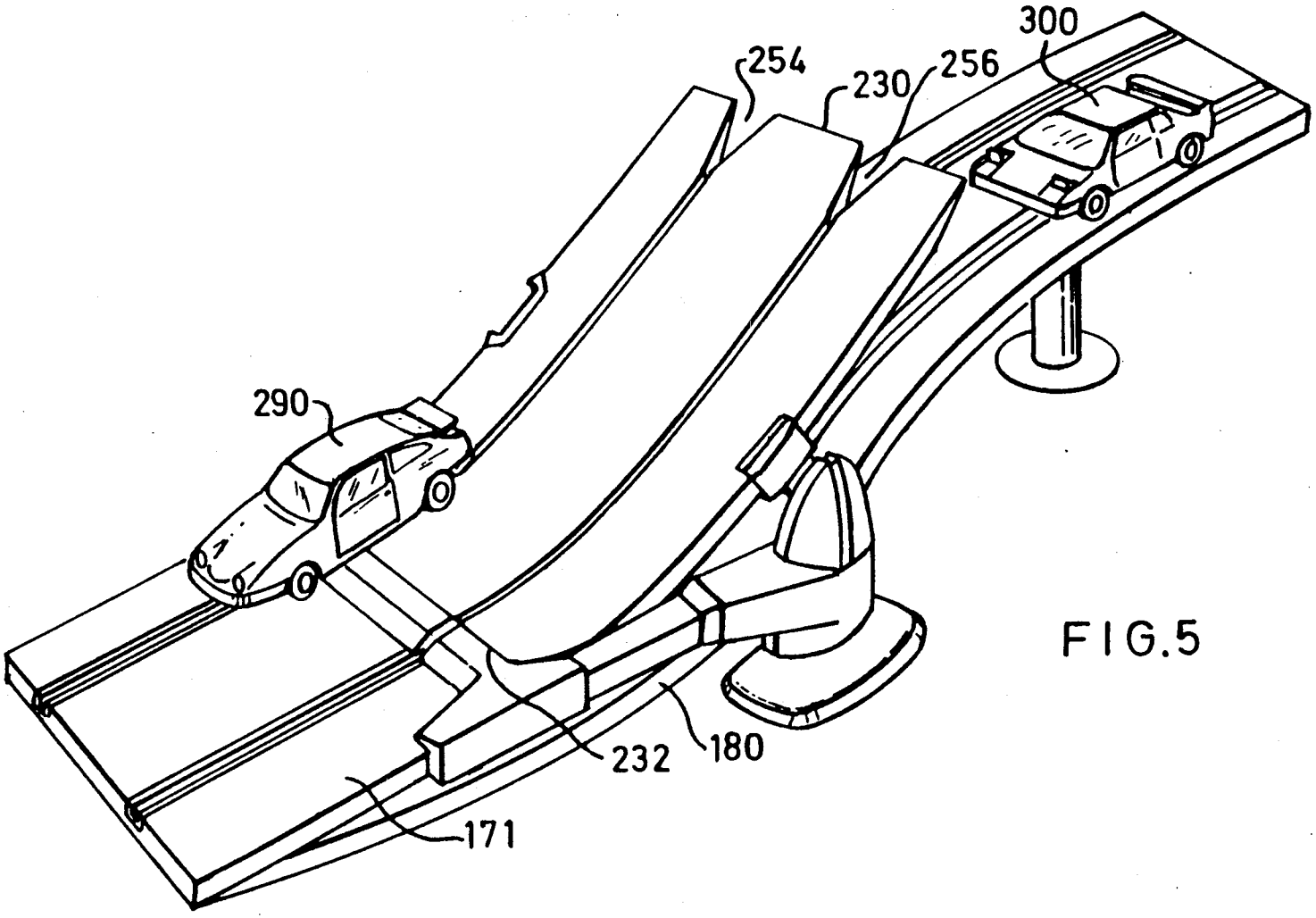
Figure 6:
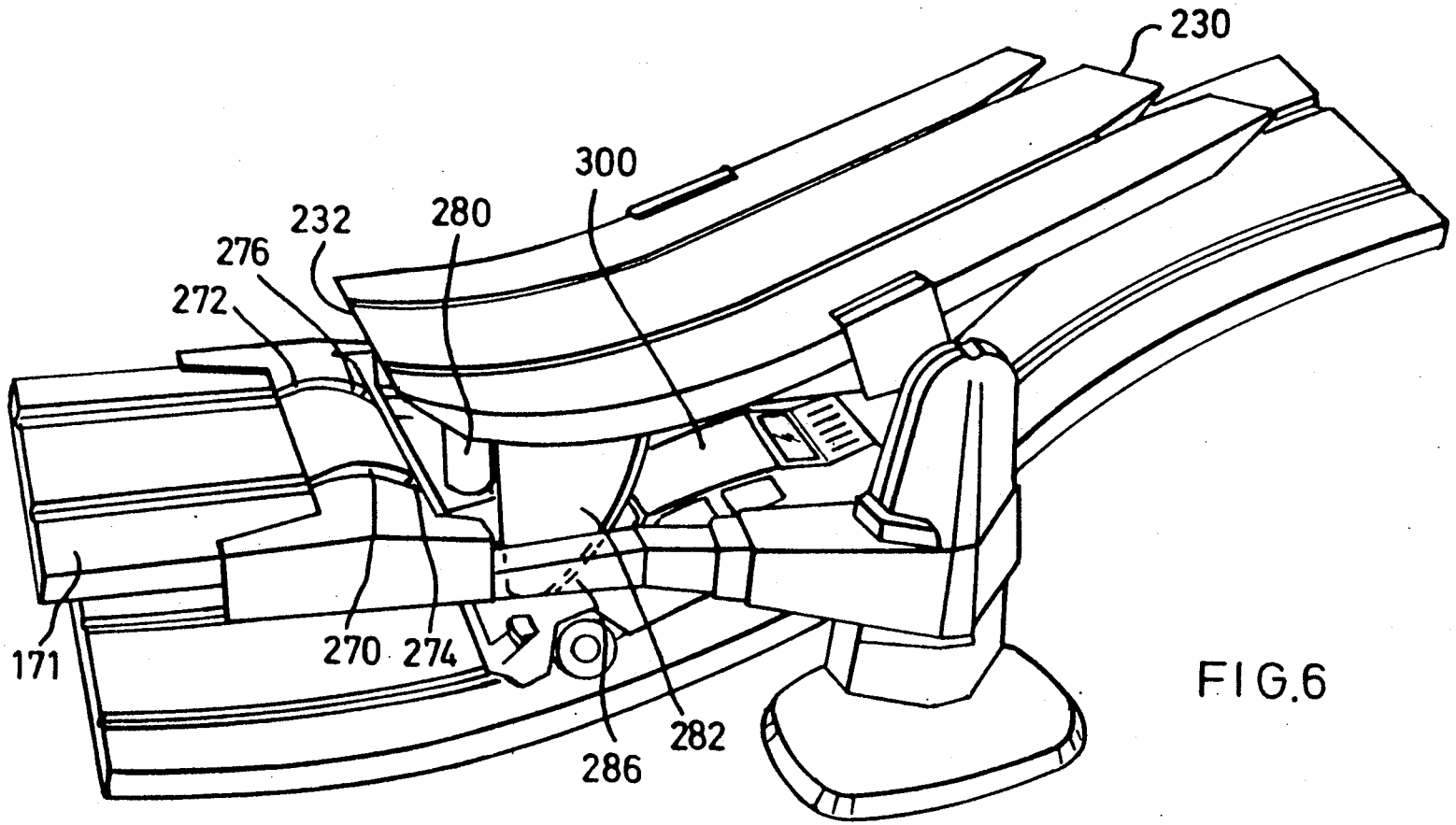

With reference to FIG. 1, a slot car racing track circuit, generally designated 100 is shown. The circuit comprises a plurality of track sections joined together, each track section having two lanes 110, 120 which each include a central slot, on either side of which positive and negative electrical rails are disposed parallel with the slot. Slot racing cars, for example, as shown schematically in FIGS. 4, 5 and 6 are each provided with a projection to engage a said slot so as to be guided thereby and with electrical pick ups in alignment with the electrical rails. The cars are each controlled by a hand controller 130, 140 which connects to the track via a power control unit 150.

Figure 3:
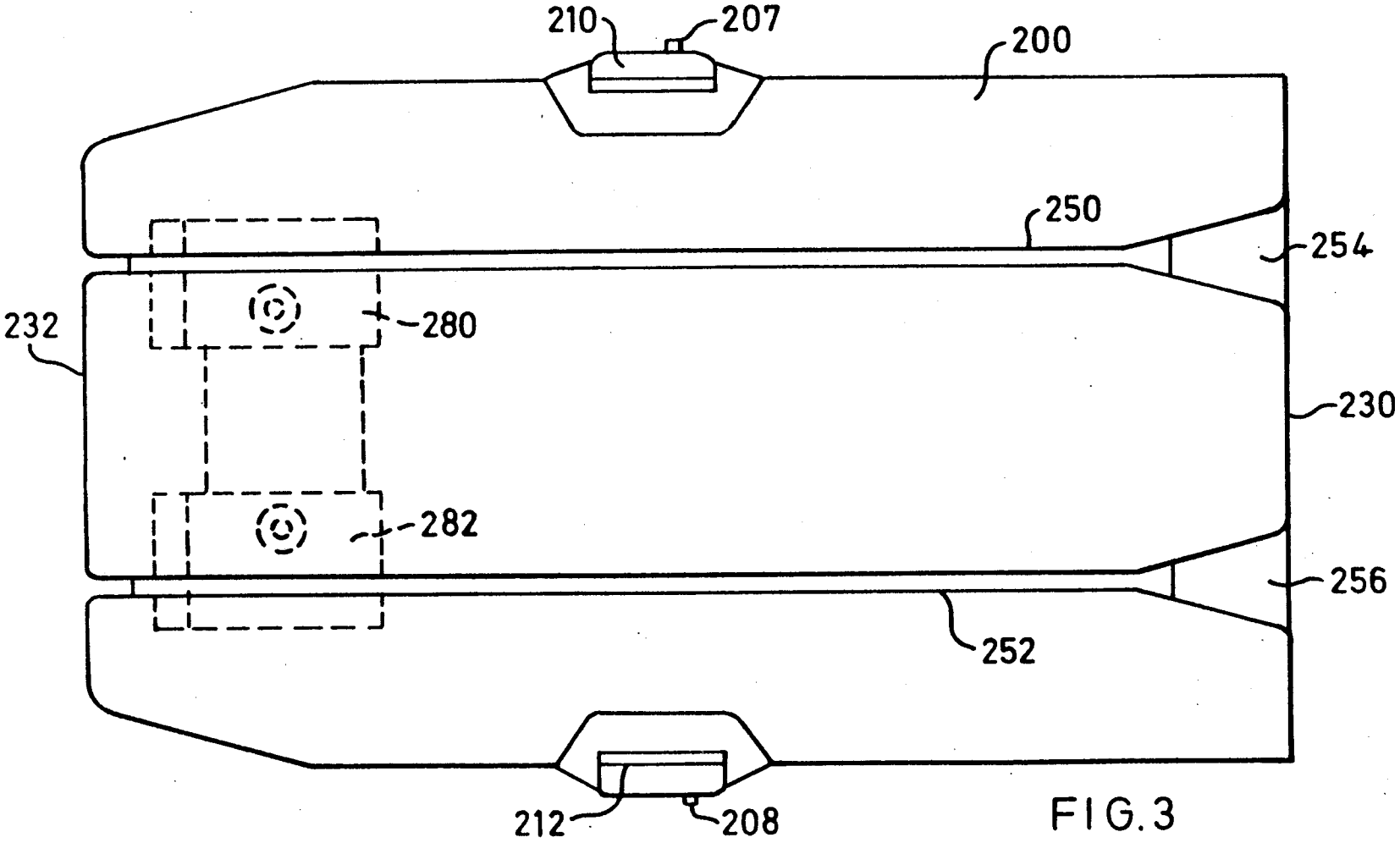
FIG. 3 is a plan view of the pivotally supported platform of the embodiment shown in FIG. 2.

In addition to the basic circuit, the track is provided with a route diverter 160 in the form of a pivotally supported platform 200. Depending on the state of the diverter 160, one of a first route 170 or a second route 180 is chosen for an approaching car to follow. The routes 170, 180 follow different paths, the route 180 including convex and concave track sections 300, 302 (FIG. 3) which cause the track to follow a rapidly downwardly depending path, the route then following a meandering path to meet a junction 190, the route 170 following a far more direct and gentle downward path to the junction 190. The section of track 196 leading to the diverter 160 is raised above ground level and supported by means of pillars 197.

The diverter 160 is shown in more detail in FIGS. 2–5 and comprises a platform 200 which is supported between two columns 202 and 204. The platform 200 is connected to the columns 202, 204 via pivots 205, 206. The pivots 205, 206 are formed by legs 210, 212 attached to the platform 200, each leg having a generally triangular Protrusion 207, 208 which is received in a corresponding arcuate depression (eg, 214 in FIG. 2) formed in each column. Each depression 214 allows a said protrusion 206, 208 to move within an angular range defined by the radial edges of the depression thus allowing the platform 200 to swing between two positions, the first position being as shown in FIG. 4 in which a trailing edge of the platform 230 engages the track 100 and a second position in which a leading edge 232 of the platform 200 engages a support member 240. The support member 240 is connected between the two columns 202, 204 and includes a connector 241 having a socket 212 for engagement with a track section 171 of route 170 and having slots 270 272 in alignment with corresponding vehicle guidance slots of the track section 171. Each slot 270, 272 is provided with a lead in portion 274, 276 of increased width.

The platform 200 is provided with first and second slots 250, 252 which are of generally the same configuration as the vehicle guidance slots of the track itself but include lead in portions 254, 256 of increased width Both the trailing and leading edges 230 and 232 of the platform have bevelled surfaces 258, 260 which allow the platform smoothly to engage the track when in the two positions shown in FIGS. 4 and 5.

Figure 2:
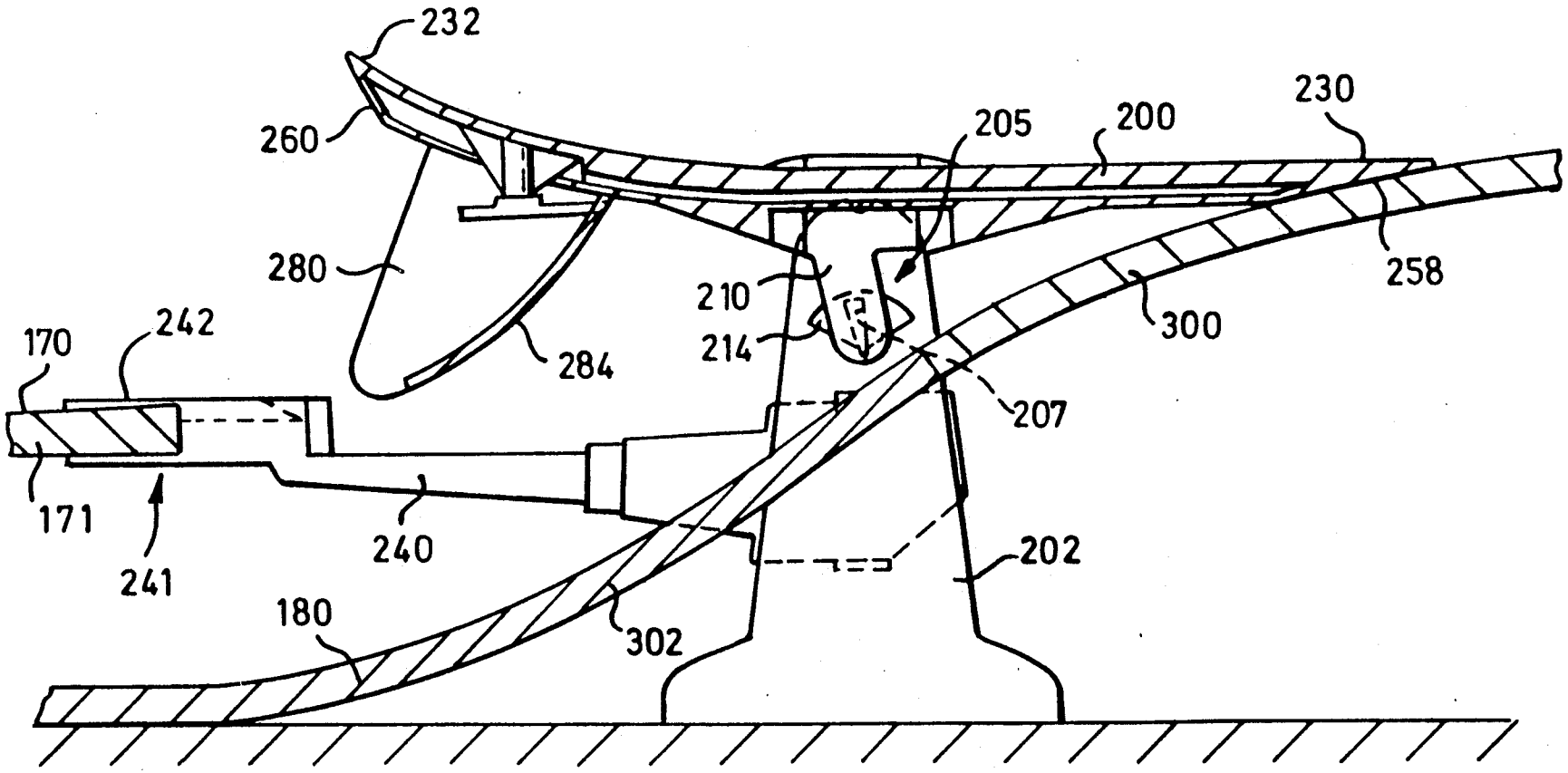
FIG. 2 is a cross sectional view of the embodiment of the invention shown in FIG. 1, across the centre line of the track.

In the first position shown in FIGS. 2 and 4, the platform 200 overlies track section 300 of the second route and provides a ramp on to which a vehicle approaching the platform will be propelled.

When in the second position, the trailing edge 230 of the platform 200 is raised, as shown in FIG. 5 thus exposing the second route 180 and the leading edge 232 of the platform 200 engages the support member 240, with the slots 250, 252 aligning with slots 270, 272.

The platform 200 is further provided with first and second restoring members 280, 282 which are in alignment with the first and second lanes 120, 110 so that, when the platform 200 is in the second position, the restoring members 280, 282 obstruct the lanes 120, 110 on the second route 180. Each member 280, 282 has a trailing edge 284, 286 which is arcuately slanted in the direction of movement of vehicles along the track.

Operation of the route diverter of the embodiment of the invention is illustrated in FIGS. 4–6.

With reference to FIG. 4, as a first slot racing car 290 approaches the platform 200 it will be propelled onto the platform by its momentum. As the car 290 moves across the platform 200 guided by slot 250 it will pass the position of the pivots 205, 206 and its weight will cause the platform 200 to swing to the position shown in FIG. 5 so that the platform 200 and car 290 are now aligned with the first route 170. Movement of the car 290 over the platform 200 will also raise trailing edge 230 and thus change the available route for a subsequent vehicle 300 which will be constrained to follow route 180.

Although the platform 200 is not provided with electrical connectors, so that the car 290 will not be powered as it travels over the surface of platform 200, the momentum of the car will propel the car forward and once the car 290 has passed the pivots, the platform will swing to the second position and gravity will then assist movement of the car 290 off the platform and on to first route 170, as the first route 170 is at a lower height.

Once the platform 200 has moved to the second position as shown in FIG. 5, the car 300 will be constrained to follow the second route 180, as shown in FIG. 6. As the platform 200 has moved to the second position, the restoring members 282, 284 now lie in the path of the second route 180 and as car 300 follows this route, it will strike member 282 thus causing the platform 200 to pivot clockwise and return to the first position shown in FIG. 2.

The embodiment of the invention as described is not to be construed as limitative. For example, the number of lanes at the track need not be limited to two. Furthermore, the diverter may be independently powered and need not rely on the weight of the vehicle to change the lane selection.

I claim:

1. A pivotably supported route diverter for the toy vehicles of a slot racing track, the racing track having a first route and a second, different, route for selection by the diverter, the diverter comprising:

a platform having a first mechanically stable position and a second mechanically stable position in which the platform forms part of the first route and causes a vehicle to be diverted to the second route, said platform having a first edge at which a vehicle enters the platform and a second edge at which it leaves the platform;

two columns for pivotally supporting said platform therebetween by means of pivot connections on each side of said platform, said platform pivoting about a generally horizontal axis between said first and second positions, a part of the second route extending between said columns and under the platform;

the first edge of the platform lying above the part of said second route and being horizontally aligned with part of the first route when the platform is in the second position; and a restoring member fixed to and extending below the platform above the part of the second route;

whereby the platform is caused, in use, to pivot from its first position to its second position by the weight of a vehicle passing thereover and to pivot from its second position to its first position by a vehicle striking the restoring member as it proceeds along the part of the second route.

2. The diverter according to claim 1, including a support members fixed to and extending from said columns at either side of the part of the second route, a part of the first route being supported by the support members.

3. A pivotably supported route diverter for the toy vehicles of a slot racing track, the racing track formed by a pair of side by said lanes formed to provide a first route and a second, different, route for selection by the diverter, each route comprising the pair of lanes extending along a part of the track, the diverter comprising:

a platform having a first mechanically stable position and a second mechanically stable position in which the platform forms part of the first route and causes a vehicle in either of the lanes to be diverted to the second route, said platform having a first edge at which a vehicle enters the platform and a second edge at which it leaves the platform;

two columns for pivotally supporting said platform therebetween by means of pivot connections on either side of said platform, said platform pivoting about a generally horizontal axis between said first and second positions, a part of the second route extending between said columns;

the first edge of the platform lying above the part of said second route and being horizontally aligned with part of the first route when the platform is in the second position; and a restoring member fixed to and extending below the platform above said part of the second route;

the platform being caused in use to pivot from its first position to its second position by the weight of a vehicle passing thereover and to pivot from its second position to its first position by a vehicle striking the restoring member as it proceeds along the part of the second route.

4. A diverter according to claim 3, including a support members fixed to and extending from said columns at either side of the part of the second route, a part of the first route being supported by the support members.

* * * * *